US006466121B1

(12) United States Patent
Moreno et al.

(10) Patent No.: US 6,466,121 B1
(45) Date of Patent: Oct. 15, 2002

(54) COIL ASSEMBLY

(75) Inventors: Alejandro Moreno, El Paso, TX (US); Omar Rocha, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/483,210

(22) Filed: Jan. 14, 2000

(51) Int. Cl.[7] ..... H01F 27/30
(52) U.S. Cl. ..... 336/198; 336/208; 336/192
(58) Field of Search ..... 336/198, 192, 336/208, 96, 205; 29/602.1

(56) References Cited

U.S. PATENT DOCUMENTS 4,274,136 A * 6/1981 Onodera et al. ..... 363/68
4,639,706 A * 1/1987 Shimizu ..... 336/170
5,952,908 A * 9/1999 Kubo ..... 336/192

* cited by examiner

*Primary Examiner*—Anh Mai
(74) *Attorney, Agent, or Firm*—Margaret A. Dobrowitsky

(57) ABSTRACT

A coil assembly includes a spool (102) having an upper flange (104), a medial flange (106) and a lower flange (108). A terminal groove (118) is established between the upper flange (104) and the medial flange (106), and a winding bay (110) is established between the medial flange (106) and the lower flange (108). Ramps (130) are formed in the groove (118) and at least two terminal posts (126), each having a foot (128), are inserted through the upper flange such that each foot (128) is disposed within the groove (118). Each terminal post (126) is movable between a winding position, wherein the foot (128) protrudes outwardly to facilitate engaging a coil wire end (132), and a retracted position, wherein the foot (128) is retracted behind the respective ramp (130).

12 Claims, 2 Drawing Sheets

COIL ASSEMBLY

TECHNICAL FIELD

The present invention relates to electric coils used in motor vehicle sensors and actuators.

BACKGROUND OF THE INVENTION

Most motor vehicles include a plethora of sensors and actuators incorporated into the vehicle control systems, such as the anti-lock braking system (A.B.S.), the traction control system (T.C.S.), and the vehicle stability enhancement control system (V.S.E.). Many of-the sensors and actuators used in these controls systems include an electric coil that is used to move a plunger when energized or to provide a signal in response to a change in magnetic flux around the coil.

In general, these coils include a spool with wire wound around it numerous times. The ends of the wire are connected to terminals that, in turn, can be electrically connected to a control system to allow the coil to be energized or to send a signal to the control system.

It happens that termination point electrical isolation requirements must be met in order for the coil to function properly. Traditional methods of isolation include placing a plastic sleeve or clip over the wire and terminal connection point and then shrink wrapping the entire coil assembly. This method includes several added process steps which consume time and increase manufacturing costs.

Accordingly, the present invention recognizes the need for a coil in which the coil wire is connected to the terminals and then isolated in a manner that minimizes manufacturing time and costs.

SUMMARY OF THE INVENTION

A coil assembly includes a spool that has a top and a bottom. The spool forms a groove near the top and a winding bay between the groove and the bottom of the spool. At least one ramp is formed in the groove. Moreover, the coil assembly includes at least two terminal posts and each terminal post has a foot that is disposed within the groove.

As described in detail below, each terminal post is movable between a winding position, wherein the respective foot protrudes outwardly from the spool, and a retracted position wherein the foot is disposed behind a ramp. Furthermore, at least one wire is included and each wire has at least two ends. The wire is wrapped around the winding bay to form a coil and the ends of the wire are connected to respective terminal posts.

As envisioned in a preferred embodiment and described in detail below, the spool has an upper flange and a medial flange, between which the groove is established. Moreover, the spool includes a lower flange. A winding bay is established between the lower flange and the medial flange. Preferably, the upper flange forms at least two holes that are sized to receive the terminals.

In a preferred embodiment, the spool has at least two terminal support collars that extend from the upper flange. Each support collar forms a hole that is sized to receive a terminal. Furthermore, the coil assembly includes a protective shroud that is disposed around the coil. Also in a preferred embodiment, each terminal foot includes a heel and a toe and the ramps are configured in such a manner that the lower portion of each ramp is closest to the heel of the terminal foot. As the terminal is rotated, the toe of the terminal foot rides up the ramp until the terminal foot snaps behind the ramp into the retracted position.

In another aspect of the present invention, a coil assembly includes a spool that defines a groove. A coil of wire is wound on the spool and the coil defines two ends. Moreover, the coil assembly includes at least two terminal posts that are movable on the spool between a winding position, wherein a respective end can be engaged with the post, and a retracted position, wherein the respective end is disposed in the groove.

In yet another aspect of the present invention, a coil assembly is manufactured by providing a spool that has a center, a top, a bottom, a winding bay between the top and bottom, and a groove between the top and the winding bay. Also, at least one ramp is formed in the groove and at least two metal terminal posts, each terminal post having a foot, is inserted through the spool such that the foot is within the groove. Moreover, at least one wire having at least two ends is provided and wrapped around the winding bay to form a coil.

In this aspect of the present invention each end of the wire is wrapped around a respective terminal foot and then each end of the wire is soldered in place. Once the ends of the wire are attached to the terminal feet, each terminal post is rotated so that the respective terminal foot rotates toward the center of the spool until each terminal foot is retracted within the groove.

The present invention will now be described, by way of example, with reference to the accompanying drawings, in which:

DESCRIPTION OF THE PREFERRED EMBODIMENT

Figure 1:
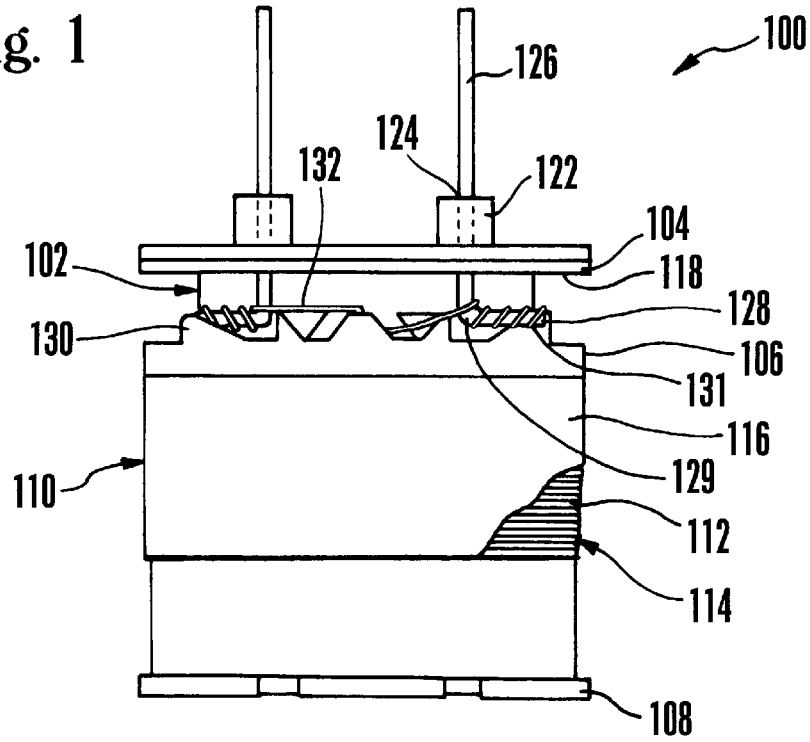
FIG. 1 is a side elevational view of the coil assembly with a portion of the protective shroud removed to reveal the coil.
Figure 2:
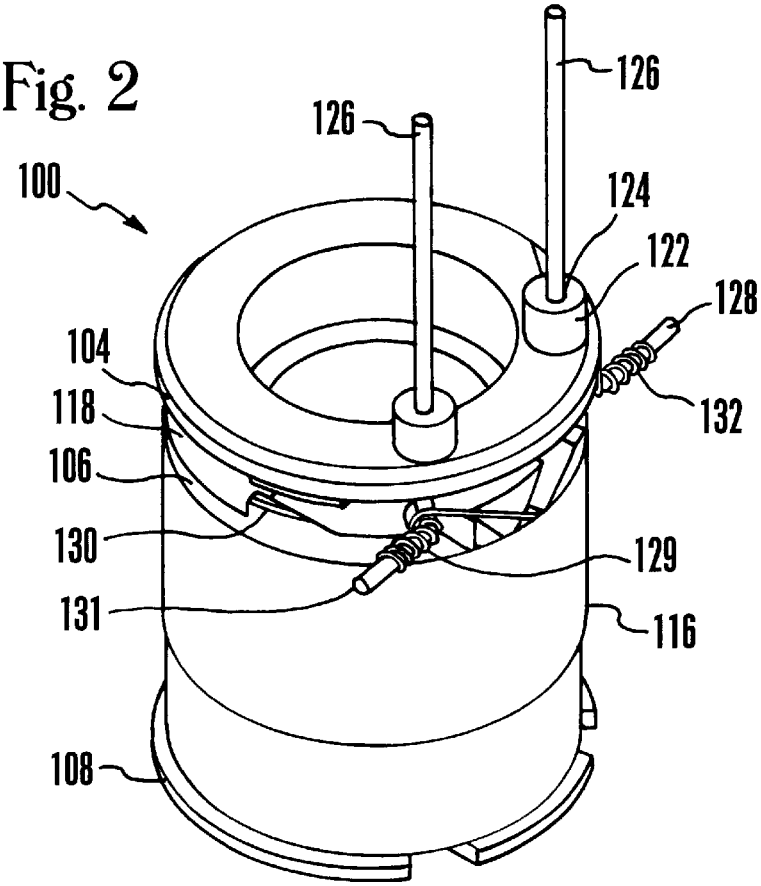
FIG. 2 is a perspective view with the terminals in the winding position with portions of the terminal posts shown in phantom.
Figure 3:
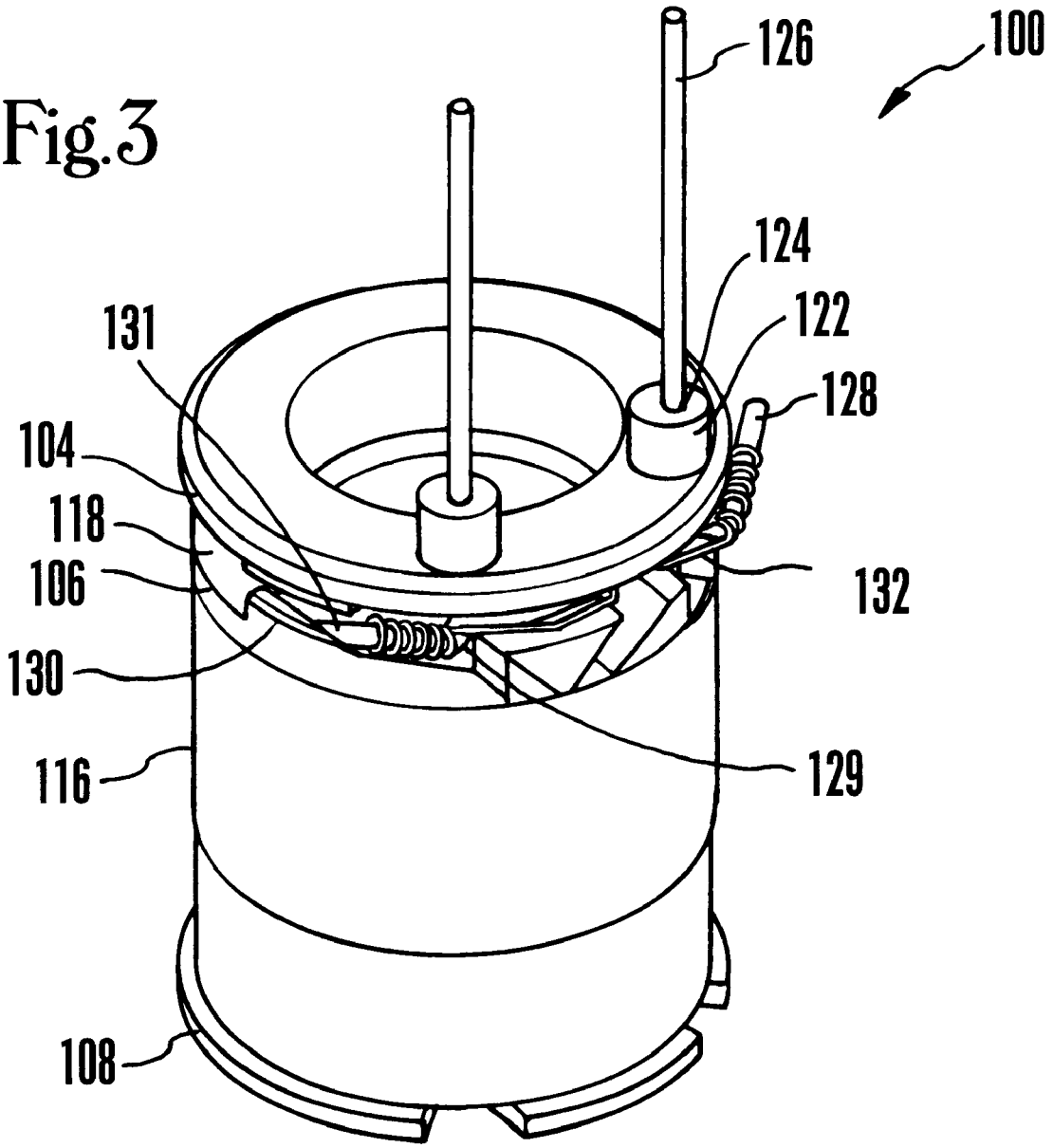
FIG. 3 is a perspective view with the terminals in the recessed position with portions of the terminal posts shown in phantom.

Referring initially to FIG. 1, a coil assembly is shown and generally designated 100. FIGS. 1 through 3 show that the coil assembly 100 includes, a preferably plastic, hollow generally I-shaped spool 102 having an upper flange 104, a medial flange 106, and a lower flange 108. Between the medial flange 106 and the lower flange 108 is a winding bay 110 (FIG. 1) onto which a wire 112 is wound to form a coil 114. A protective shroud 116 is disposed around the coil 114 to protect it from being damaged.

FIGS. 1, 2 and 3 also show a circular terminal groove 118 that is established between the upper flange 104 and the medial flange 106 with the groove 118 circumscribing the spool 102. Two hollow cylindrical terminal support collars 122 extend perpendicularly and outwardly from the upper flange 104. Each support collar 122 is formed with a hole 124 sized to receive a metal terminal post 126.

Still referring to FIGS. 1 through 3, each terminal post 126 includes a respective foot 128 having a heel 129 and a toe 131. When the terminals 126 are inserted in the terminal support collars 122, each foot 128 is positioned between the upper flange 104 and the medial flange 106 so that when they are properly snapped in place, as discussed below, they will be retracted within the terminal groove 118.

FIGS. 1, 2, and 3 show that the medial flange 106 forms two ramps 130 that are located in the terminal groove 118.

Each ramp 130 is formed in proximity to a terminal foot 128 such that the lowest portion of the ramp 130 is closest to the heel 129 of the terminal foot 128 and the height of the ramp 130 increases away from the heel 129 of the foot 128. FIGS. 1 through 3 also show that the wire 112 comprising the coil 114 has two ends 132.

Referring now to FIG. 2, each terminal foot 128 is shown in the winding position. In the winding position, a respective wire end 132 can be easily wound around each terminal foot 128. Once the wire ends 132 are properly wrapped, the wire ends 132 are soldered to the feet 128 and then each terminal 126 is rotated about its axis so that its respective foot 128 rotates toward the center of the spool 102. For clarity, looking down at FIG. 2, the terminal 126 on the left is rotated clockwise and the terminal 126 on the right is rotated counterclockwise.

As the terminals 126 are rotated, the toe 131 of each foot 128 will travel up the respective ramp 130, until each foot 128 snaps behind a ramp 130 into the retracted position, as seen in FIG. 3. In the retracted position the wire/terminal connections will be safely disposed within the terminal groove 118. A piece of tape (not shown) can then be wrapped around the coil assembly 100 to cover the terminal groove 118 and isolate and protect the wire/terminal connections.

Referring to FIG. 2, it is shown that each terminal foot 128 can be slightly curved toward the center of the spool 102 so that when each foot 128 is in the retracted position the shape of each foot 128 will slightly mirror the curvature of the spool 102 and the terminal feet 128 will not protrude from the terminal groove 118.

As understood by the present invention, by connecting the wire ends 132 to the terminal feet 128 and then rotating the terminal feet 128 into the retracted position, extra steps to install sleeves or clips over the wire/terminal connections are not necessary. Moreover, the wire/terminal connections are safely protected within the terminal groove 118. Eliminating process steps and minimizing the amount of material necessary to make the spool saves time and reduces costs.

While the particular coil assembly as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A coil assembly for motor vehicle actuators comprising:

a spool having a top and a bottom, the spool formed with a groove near the top and a winding bay between the groove and the bottom;

at least one ramp formed in the groove;

at least two terminal posts, each terminal post having a foot disposed within the groove, each terminal post being movable between a winding position, wherein the respective foot protrudes outwardly from the spool, and a retracted position, wherein each foot is disposed behind respective ramps; and at least one wire having at least two ends, the wire wrapped around the winding bay to form a coil, the ends of the wire being connected to respective terminal posts.

2. The coil assembly of claim 1, wherein the spool further comprises an upper flange and a medial flange, the groove being established between the flanges.

3. The coil assembly of claim 2, wherein the spool further comprises a lower flange, the winding bay being established between the lower flange and the medial flange.

4. The coil assembly of claim 2, wherein the upper flange is formed with at least two holes sized to receive the terminals.

5. The coil assembly of claim 4, wherein the upper flange further comprises at least two terminal support collars extending from the upper flange, each terminal support collar being formed with a hole sized to receive the respective terminal post.

6. The coil assembly of claim 1, further comprising a protective shroud disposed around the coil.

7. The coil assembly of claim 1, wherein each terminal foot further includes a heel and a toe and the ramps are configured such that a lower portion of each ramp is closest to the heel of the terminal foot, the toe of the terminal foot riding up the ramp as the terminal foot is rotated until the terminal foot snaps in place behind the ramp into the retracted position.

8. A coil assembly comprising:

a spool defining a groove;

a coil of wire wound on the spool, the coil defining two ends; and at least one ramp circumscribing the groove;

at least two metal terminal posts movable on the spool between a winding position, wherein a respective end can be engaged with the post, and a retracted position, wherein the respective end is disposed in the groove.

9. The coil assembly of claim 8, wherein the spool further comprises an upper flange formed with at least two holes sized to receive the terminal posts.

10. The coil assembly of claim 9, wherein the upper flange further comprises at least two terminal support collars extending from the upper flange, each terminal support collar being formed with a hole sized to receive the respective terminal post.

11. The coil assembly of claim 8, further comprising a protective shroud disposed around the coil.

12. The coil assembly of claim 8, wherein each terminal post includes a respective foot and each foot includes a heel and a toe, the ramps being configured such that a lower portion of each ramp is closest to the heel of the terminal foot, the toe of the terminal foot riding on the ramp as the terminal post is rotated until the terminal foot is engaged with the ramp.

* * * * *